US007274135B2

(12) United States Patent
Tagami et al.

(10) Patent No.: US 7,274,135 B2
(45) Date of Patent: Sep. 25, 2007

(54) COLOR PICTURE TUBE APPARATUS WITH PARTICULAR DEFLECTION YOKE STRUCTURE

(75) Inventors: Etsuji Tagami, Takatsuki (JP); Akitsugu Ishii, Muko (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 227 days.

(21) Appl. No.: 11/029,873

(22) Filed: Jan. 5, 2005

(65) Prior Publication Data

US 2005/0162059 A1 Jul. 28, 2005

(30) Foreign Application Priority Data

Jan. 23, 2004 (JP) ..... 2004-015733

(51) Int. Cl.
*H01J 29/70* (2006.01)

(52) U.S. Cl. ..... 313/440; 313/412; 313/413; 313/421; 313/442

(58) Field of Classification Search ..... 313/409, 313/412–414, 421, 426, 431, 440, 441, 442
See application file for complete search history.

(56) References Cited

U.S. PATENT DOCUMENTS 6,281,623 B1 * 8/2001 Suzuki et al. ..... 313/440
6,380,698 B1 4/2002 Dasgupta ..... 315/368.25
6,838,811 B2 * 1/2005 Tagami et al. ..... 313/440
6,914,505 B2 * 7/2005 Taniwa ..... 335/210
6,924,590 B2 * 8/2005 Tagami et al. ..... 313/440
7,129,627 B2 * 10/2006 Tagami ..... 313/440

FOREIGN PATENT DOCUMENTS

JP 63-241843 10/1988
JP 2003-208859 7/2003

* cited by examiner

*Primary Examiner*—Nimeshkumar D. Patel
*Assistant Examiner*—Kevin Quarterman
(74) *Attorney, Agent, or Firm*—Hamre, Schumann, Mueller & Larson, P.C.

(57) ABSTRACT

A deflection yoke includes ferrite core, horizontal deflection coil, vertical deflection coil, and insulating frame for insulating the horizontal and vertical deflection coils. The deflection yoke has a cross section that satisfies the following A to C. A: A plurality of magnetic substance convex portions projecting toward the tube axis are provided in the vicinity of a position of an inner surface of the ferrite core where a vertical axis crosses. B: Assuming that a minimum value among distances between the respective magnetic substance convex portions and a funnel is $D_1$, the distance between the ferrite core excluding the plurality of magnetic substance convex portions and the funnel is larger than the distance $D_1$ at any point of the ferrite core. C: A part of the vertical deflection coil is wound in a groove between the plurality of magnetic substance convex portions.

12 Claims, 7 Drawing Sheets

COLOR PICTURE TUBE APPARATUS WITH PARTICULAR DEFLECTION YOKE STRUCTURE

BACKGROUND OF THE INVENTION

1. Field of the Invention

The present invention relates to a color picture tube apparatus used in a TV, a computer display, or the like.

2. Description of the Related Art

In terms of the recent global environmental protection movement and the like, the energy savings in electrical products are being promoted. Even in a color picture tube apparatus, energy-saving technology based on deflection power is being introduced.

In order to reduce deflection power, for example, JP2003-208859A describes a deflection yoke as shown in FIG. 7. FIG. 7 is a partial cross-sectional view of the deflection yoke along a surface vertical to a tube axis. In FIG. 7, an X-axis represents a horizontal axis, and a Y-axis represents a vertical axis. The deflection yoke 100 includes an insulating frame 101, a pair of upper and lower saddle-type horizontal deflection coils 102 provided on an inner surface side of the insulating frame 101, a pair of right and left saddle-type vertical deflection coils 103 provided on an outer surface side of the insulating frame 101, and a core 104 covering an outer surface side of the saddle-type vertical deflection coils 103. Reference numeral 2 denotes a funnel of a color picture tube. A pair of upper and lower magnetic substance projections 104*a* are provided in the vicinity of positions of an inner surface of the core 104 where the Y-axis crosses. The pair of upper and lower magnetic substance projections 104*a* extend through between the pair of right and left saddle-type vertical deflection coils 103, and project to the vicinity of the pair of upper and lower saddle-type horizontal deflection coils 102. This enables each top portion of the pair of upper and lower magnetic substance projections 104*a* to be close to a deflection region of an electron beam. Therefore, the magnetic resistance of a horizontal deflection magnetic field can be decreased, and the horizontal deflection magnetic field in the deflection region can be intensified. Consequently, deflection power can be reduced.

In the above-mentioned conventional deflection yoke 100, as the horizontal width $W_0$ of the pair of upper and lower magnetic substance projections 104*a* is increased, the effect of reducing the deflection power is increased. However, when the horizontal width $W_0$ is increased, there are the following problems: a horizontal interval between the pair of right and left saddle-type vertical deflection coils 103 is enlarged so as to avoid the interference with respect to the magnetic substance projections 104*a*, and a barrel magnetic field of a vertical deflection magnetic field is intensified more than necessary, whereby a misconvergence and raster distortion occur.

More specifically, in the above-mentioned conventional deflection yoke, it is difficult to further reduce horizontal deflection power while forming a barrel magnetic field capable of realizing a satisfactory convergence and raster.

SUMMARY OF THE INVENTION

The present invention has been achieved in order to solve the above-mentioned problems of the prior art, and its object is to provide a color picture tube apparatus capable of realizing a satisfactory convergence and raster while sufficiently exhibiting a power-saving effect.

A color picture tube apparatus of the present invention includes: an envelope composed of a front panel and a funnel; an electron gun provided in a neck portion of the funnel; and a deflection yoke for allowing a horizontal deflection magnetic field and a vertical deflection magnetic field to act on three electron beams emitted from the electron gun in an in-line shape, thereby deflecting the three electron beams in a horizontal direction and a vertical direction. The deflection yoke includes a ferrite core, a horizontal deflection coil for generating the horizontal deflection magnetic field, a vertical deflection coil for generating the vertical deflection magnetic field, and an insulating frame for insulating the horizontal deflection coil from the vertical deflection coil. Assuming that a tube axis is a Z-axis, an axis in a horizontal direction orthogonal to the Z-axis is an X-axis, and an axis in a vertical direction orthogonal to the Z-axis and the X-axis is a Y-axis, the horizontal deflection coil has a window portion, in which a winding is not present, at a position where a YZ-plane including the Y-axis and the Z-axis crosses. The deflection yoke has at least one cross section orthogonal to the Z-axis that satisfies the following A to C.

A. In the cross section, a plurality of magnetic substance convex portions projecting toward the Z-axis are provided in the vicinity of a position of an inner surface of the ferrite core where the Y-axis crosses.

B. In the cross section, assuming that a minimum value among distances between the respective plurality of magnetic substance convex portions and the funnel is $D_1$, a distance between the ferrite core excluding the plurality of magnetic substance convex portions and the funnel is larger than the distance $D_1$ at any point of the ferrite core.

C. Apart of the vertical deflection coil is wound in a groove between the plurality of magnetic substance convex portions.

These and other advantages of the present invention will become apparent to those skilled in the art upon reading and understanding the following detailed description with reference to the accompanying figures.

DESCRIPTION OF THE PREFERRED EMBODIMENTS

Figure 1:
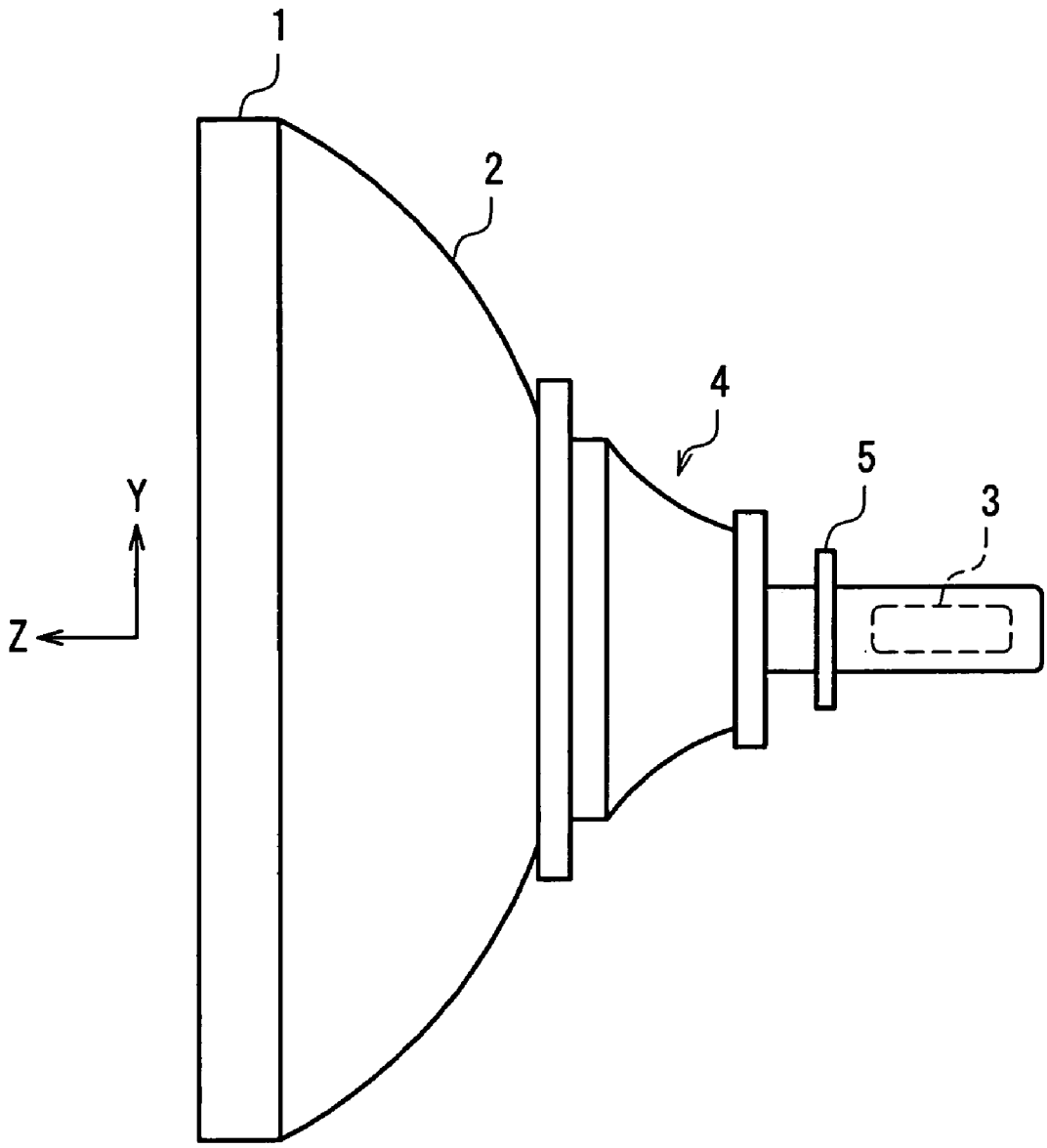
FIG. 1 is a view showing an outer appearance of a color picture tube apparatus according to one embodiment of the present invention.

According to the present invention, a color picture tube apparatus can be provided, which has a sufficient power-saving effect, and is capable of displaying an excellent image with a satisfactory convergence and raster.

In the above-mentioned color picture tube apparatus of the present invention, it is preferable that, in the cross section, the plurality of magnetic substance convex portions are provided in a range of ±30° from the Y-axis with respect to the Z-axis. According to this configuration, the magnetic resistance of a horizontal deflection magnetic field can be decreased, so that horizontal deflection power can be reduced further.

It is preferable that the vertical deflection coil is a toroidal type in the part wound in the groove, and is a saddle type in a part other than the part wound in the groove. According to this configuration, coils can be formed separately in accordance with the winding position of a winding. In particular, it is preferable that the saddle-type portion is a mold winding coil wound using a mold, due to the satisfactory productivity, the enhanced precision of a winding position, and the enhanced degree of freedom in the winding arrangement.

Furthermore, it is preferable that the horizontal deflection coil is a mold winding coil wound using a mold. According to this configuration, the productivity of the horizontal deflection coil is enhanced, and the precision of a winding position and the degree of freedom in a winding arrangement are enhanced.

Furthermore, it is preferable that, in the cross section, the insulating frame includes an insulating frame convex portion projecting toward the window portion in a region opposed to the plurality of magnetic substance convex portions. According to this configuration, the insulation between the horizontal deflection coil and the vertical deflection coil can be kept easily, and furthermore, the plurality of magnetic substance convex portions can be set to be close to the funnel to reduce deflection power.

In this case, it is preferable that the insulating frame convex portion is inserted in the window portion of the horizontal deflection coil. According to this configuration, the plurality of magnetic substance convex portions can be set to be close to the funnel, so that deflection power can be reduced further.

Furthermore, in the color picture tube apparatus of the present invention, it is preferable that, in the cross section, the plurality of magnetic substance convex portions are inserted in the window portion of the horizontal deflection coil. According to this configuration, the magnetic substance convex portions can be set to be dose to the funnel, so that deflection power can be reduced further.

Furthermore, it is preferable that the vertical deflection coil is a toroidal type in the part wound in the groove and a part other than the part wound in the groove. According to this configuration, the vertical deflection coil can be formed by allowing one wire to turn around the ferrite core continuously, so that the operation for forming the vertical deflection coil becomes easy.

Furthermore, it is preferable that, in the cross section, a plurality of second convex portions projecting toward the Z-axis are provided in a region of an inner surface of the ferrite core other than a region opposed to the window portion of the horizontal deflection coil, and a part of the vertical deflection coil is wound in a second groove between the plurality of second convex portions. By providing the second convex portions, deflection power can be reduced further.

In this case, assuming that a distance between the second convex portions and the funnel is $D_2$, it is preferable that $D_1<D_2$ is satisfied. According to this configuration, the magnetic resistance of a horizontal deflection magnetic field can be decreased further.

It is preferable that the insulating frame convex portion is composed of a component separate from a component constituting a portion of the insulating frame other than the insulating frame convex portion. According to this configuration, the moldability of the insulating frame is enhanced.

Assuming that a size of the ferrite core along the Z-axis is L, it is preferable that the cross section discussed above is present at least between an end of the ferrite core on the electron gun side and a position away from the end of the ferrite core on the electron gun side toward the front panel side by (⅔)×L. By providing the magnetic substance convex portions satisfying the above-mentioned A to C in a region on a small diameter side where the distance to the electron beams is small, a larger power-saving effect can be obtained.

Hereinafter, preferable embodiments of the present invention will be described in detail by showing numerical value examples (hereinafter, referred to as "examples") suitable for a color picture tube apparatus with a diagonal size of 36 inches. However, the following embodiments and numerical value examples are shown merely for illustrative purpose, and the present invention is not limited thereto.

Embodiment 1

FIG. 1 is a view showing an outer appearance of a color picture tube apparatus having a flat screen to which the present invention is applied. For convenience of the following description, it is assumed that a tube axis is a Z-axis, an axis in a horizontal direction (long side direction of a screen) orthogonal to the Z-axis is an X-axis, and an axis in a vertical direction (short side direction of a screen) orthogonal to the Z-axis a Y-axis. The X-axis and the Y-axis cross each other on the Z-axis.

A color picture tube (CRT) includes an envelope composed of a flat front panel 1 having a phosphor screen (not shown) formed on an inner surface and a funnel 2, and an electron gun 3 provided in a neck portion of the funnel 2. A color picture tube apparatus includes the color picture tube, and a deflection yoke 4 and a convergence yoke 5 mounted on an outer circumferential surface of the funnel 2. The electron gun 3 includes three cathodes arranged in an in-line shape in the X-axis direction, and emits three electron beams corresponding to three colors of red (R), green (G), and blue (B) in an in-line shape.

Figure 2:
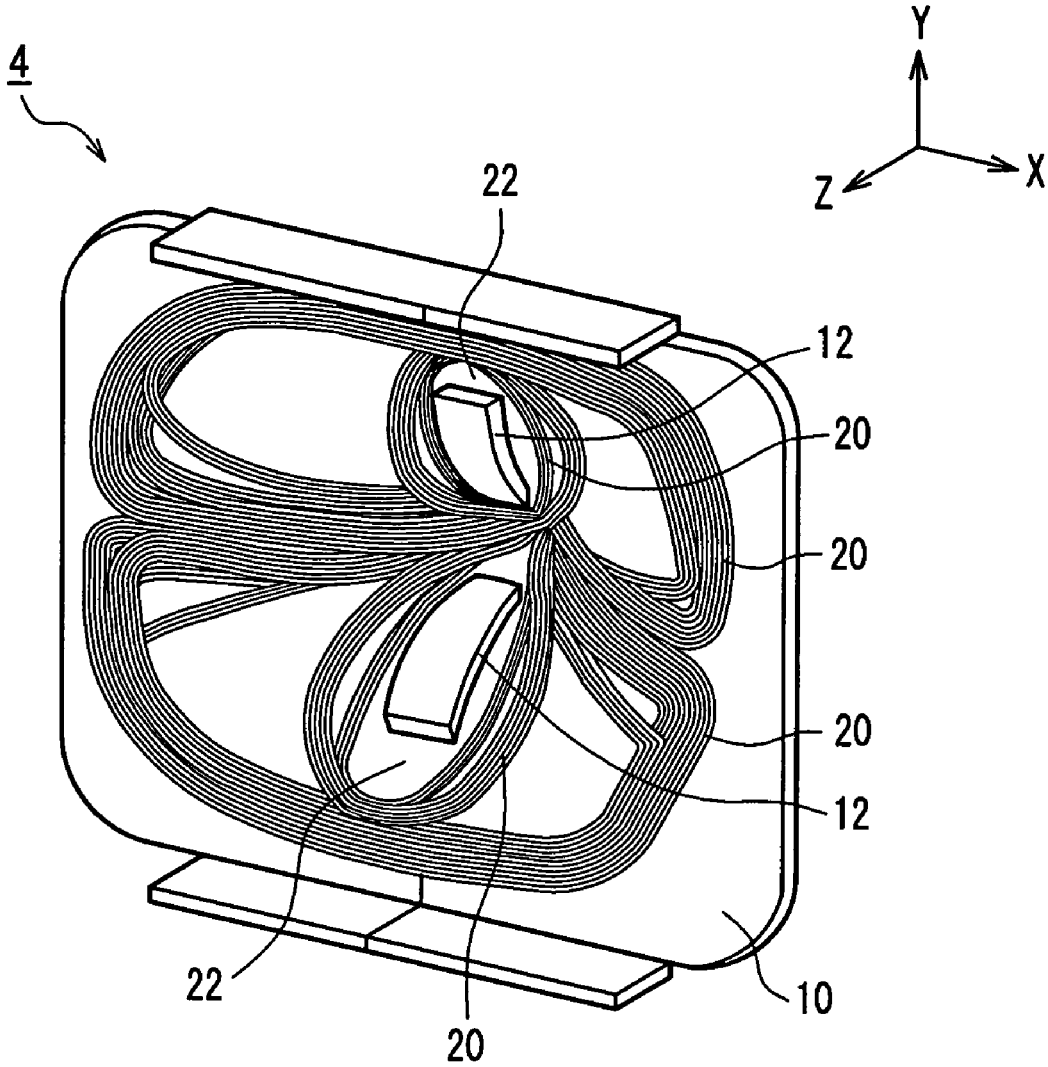
FIG. 2 is a perspective view of a deflection yoke to be mounted on the color picture tube apparatus according to one embodiment of the present invention, seen from a screen side.
Figure 3:
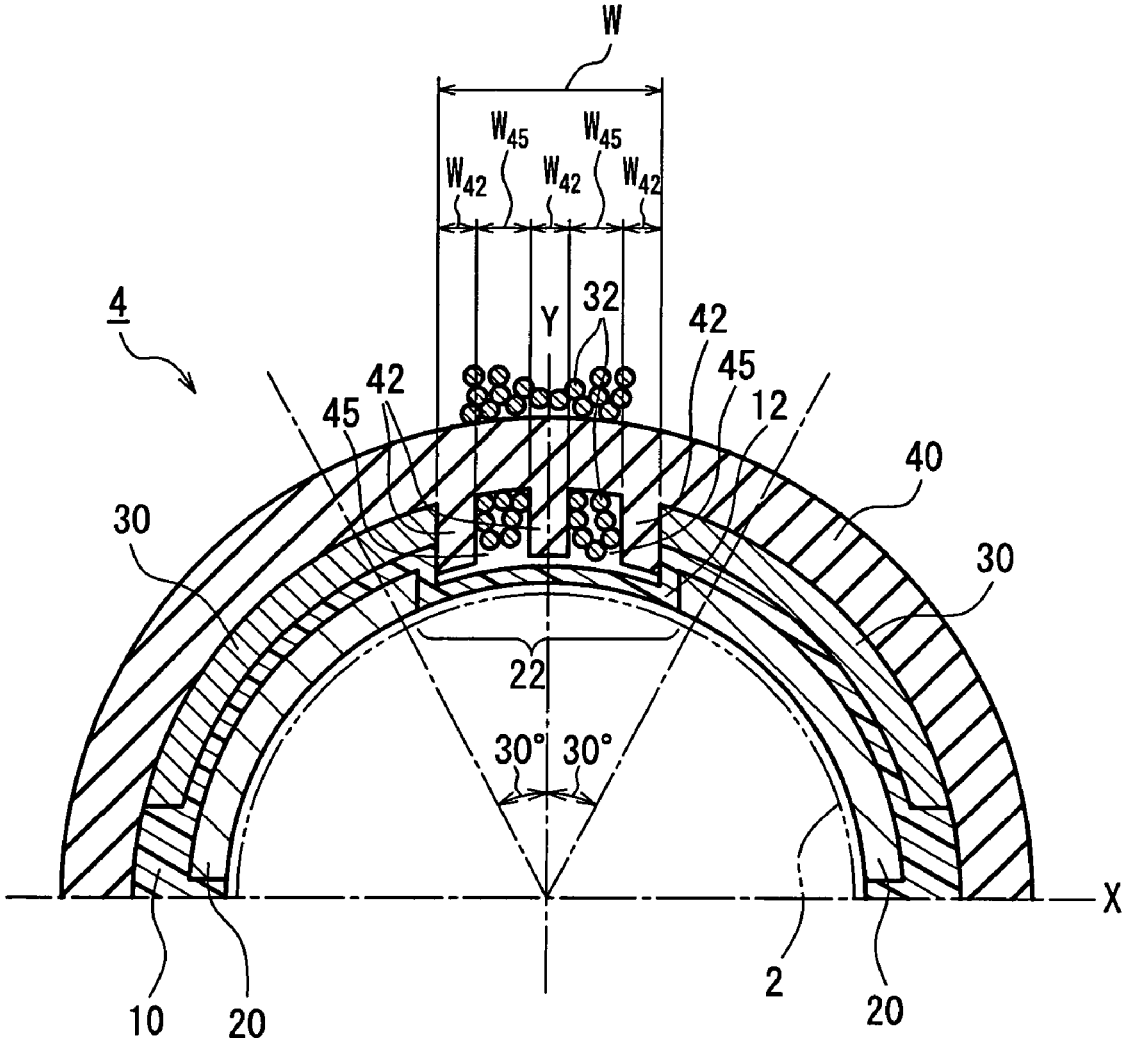
FIG. 3 is a partial cross-sectional view of a deflection yoke to be mounted on a color picture tube apparatus according to Embodiment 1 of the present invention.

FIG. 2 is a perspective view showing an outer appearance of the deflection yoke 4, seen from a screen side. Furthermore, FIG. 3 is a partial cross-sectional view of the deflection yoke 4 at a position including a ferrite core 40, taken along a surface vertical to the Z-axis. The cross-sectional shape of the deflection yoke 4 is symmetrical with respect to an XZ-plane. Therefore, FIG. 3 only shows an upper half.

The deflection yoke 4 includes the ferrite core 40, a saddle-type horizontal deflection coil 20 generating a horizontal deflection magnetic field for deflecting electron beams in a horizontal direction, vertical deflection coils 30, 32 generating a vertical deflection magnetic field for deflecting the electron beams in a vertical direction, and an insulating frame 10 made of resin for insulating the horizontal deflection coil 20 from the vertical deflection coils 30, 32. In an example, a length L of the ferrite core 40 in the Z-axis direction was set to be 48 mm.

The saddle-type horizontal deflection coil 20 is a mold winding coil produced by winding a wire in a predetermined shape using a mold having a predetermined shape, which is mounted on the insulating frame 10. It should be noted that the present invention is not limited thereto. For example, a wire may be wound using unevenness (e.g., ridge-shaped grooves) formed on the insulating frame 10. The mold winding coil is preferable due to the satisfactory productivity, the enhanced precision of a winding position, and the enhanced degree of freedom in a winding arrangement.

The first vertical deflection coil 30 is a saddle-type coil produced by winding a wire in a predetermined shape using a mold having a predetermined shape. The second vertical deflection coil 32 is a toroidal coil formed by allowing a wire to turn around the ferrite core 40.

As shown in FIG. 2, when the deflection yoke 4 is seen from the screen side, a pair of upper and lower horizontal coils 20 disposed to be symmetrical with the XZ-plane interposed therebetween can be seen on an inner side of the insulating frame 10. The winding arrangement of each of the upper and lower horizontal deflection coils 20 is substantially symmetrical with respect to a YZ-plane, and openings 22, in which the windings of the horizontal coils 20 are not present, are formed at positions where the YZ-plane crosses. According to the present invention, the opening 22 is referred to as a "window portion" of the horizontal deflection coil. Convex portions (insulating frame convex portion) 12 of the insulating frame 10 project toward the window portions 22.

As shown in FIG. 3, in the vicinity of a position of an inner surface of the ferrite core 40 where the Y-axis crosses, a plurality of magnetic substance convex portions 42 projecting toward the window portion 22 of the horizontal deflection coil 20 are formed so as to be integrated with the ferrite core 40. The magnetic substance convex portions 42 project to the Z-axis side in the vicinity of the Y-axis, whereby the magnetic resistance of a magnetic field along the Y-axis, i.e., a horizontal deflection magnetic field is decreased, and consequently, deflection power can be reduced. In the Z-axis direction, the plurality of magnetic substance convex portions 42 may extend along the entire length (48 mm in the example) of the ferrite core 40.

The plurality of magnetic substance convex portions 42 are provided in the vicinity of the Y-axis. More specifically, it is preferable that the plurality of magnetic substance convex portions 42 are provided in a range of ±30° from the Y-axis with respect to the Z-axis. The angle of each magnetic substance convex portion 42 from the Y-axis with respect to the Z-axis is defined by the center position, in a circumferential direction with respect to the Z-axis, of a top surface of the magnetic substance convex portion 42 opposed to the Z-axis.

A region of the insulating frame 10 opposed to the plurality of magnetic substance convex portions 42 is dented so as to avoid the interference with respect to the plurality of magnetic substance convex portions 42. Consequently, the insulating frame convex portion 12 that projects toward the window portion 22 is formed on the insulating frame 10. This enables the tip ends of the plurality of magnetic substance convex portions 42 on the Z-axis side to be close to the funnel 2. If the interference with respect to the plurality of magnetic substance convex portions 42 only needs to be avoided, an opening may be provided in the region of the insulating frame 10 opposed to the plurality of magnetic substance convex portions 42. However, according to the present invention, it is preferable that the insulating frame 10 is deformed to provide the insulating frame convex portion 12, instead of providing the opening. By providing the insulating frame convex portion 12, the insulation between the horizontal deflection coil 20 and the vertical deflection coils 30, 32 can be maintained easily.

In terms of the reduction in deflection power, it is preferable that the tip ends of the magnetic substance convex portions 42 on the Z-axis side are set to be as dose to the funnel 2 as possible. For this purpose, it is preferable that the insulating frame convex portion 12 is inserted in the window portion 22 of the horizontal deflection coil 20 as shown in FIG. 3. Furthermore, it is preferable that the magnetic substance convex portions 42 are inserted in the window portion 22 of the horizontal deflection coil 20.

The distance between the ferrite core 40 and the funnel 2 becomes minimum in a region of the magnetic substance convex portions 42. More specifically, assuming that the distance between the magnetic substance convex portions 42 and the funnel 2 is $D_1$, the distance between the portion of the ferrite core 40 excluding the magnetic substance convex portions 42 and the funnel 2 is larger than the distance $D_1$ at any point. Because of this, the magnetic resistance of the horizontal deflection magnetic field can be decreased further. The distance between the plurality of magnetic substance convex portions 42 and the funnel 2 is not necessarily uniform. In the case where the distance between the plurality of magnetic substance convex portions 42 and the funnel 2 is varied, the distance $D_1$ is defined regarding the magnetic substance convex portion 42 that is closest to the funnel 2.

In the example, in order to maintain the insulation between the horizontal deflection coil 20 and the vertical deflection coils 30, 32, the insulating frame convex portion 12 (thickness: 1 mm) was provided between the tip ends of the magnetic substance convex portions 42 on the Z-axis side and the funnel 2. The distance between the insulating frame convex portion 12 and the tip ends of the magnetic substance convex portions 42 on the Z-axis side was set to be 0.2 mm, and the distance between the insulating frame convex portion 12 and the funnel 2 was set to be 0.5 mm. Thus, the distance $D_1$ between the tip ends of the magnetic substance convex portions 42 on the Z-axis side and an outer surface of the funnel 2 was set to be 1.7 mm.

Needless to say, as long as the insulation can be maintained between the horizontal deflection coil 20 and the vertical deflection coils 30, 32, by providing an opening in the insulating frame convex portion 12 or by providing an opening in a region corresponding to the insulating frame convex portion 12 without providing the insulating frame convex portion 12, a part or the entirety of the plurality of magnetic substance convex portions 42 may be opposed to the funnel 2 via the opening. Thus, the tip ends of the magnetic substance convex portions 42 on the Z-axis side can be set to be closer to the funnel 2, so that deflection power can be reduced further.

The plurality of magnetic substance convex portions 42 extend in a ridge shape substantially in parallel to the YZ-plane. In the example shown in FIG. 3, one magnetic substance convex portion 42 is formed on each side of the magnetic substance convex portion 42 at the center along the YZ-plane. Consequently, two grooves 45 are formed between the adjacent magnetic substance convex portions 42. In the example, a width $W_{42}$ of each magnetic substance convex portion 42 was set to be 2 mm, and a width $W_{45}$ of the groove 45 between the adjacent magnetic substance convex portions 42 was set to be 3 mm. Thus, an outer size W from an edge of the magnetic substance convex portion 42 on one outer side to an edge of the magnetic substance convex portion 42 on the other outer side was set to be 12 mm.

A winding is wound so as to turn around the grooves 45 and an outer surface of the ferrite core 40 on an opposite side of the grooves 45, whereby the toroidal second vertical deflection coil 32 generating a vertical deflection magnetic field is formed. The second vertical deflection coil 32 is connected in series to a second vertical deflection coil (not shown) disposed so as to be symmetrical with the second vertical deflection coil 32 with respect to the XZ-plane, and also is connected in series to the saddle-type first vertical deflection coil 30, whereby a vertical deflection coil generating a vertical deflection magnetic field is formed as a whole.

According to the present invention, a part of the vertical deflection coil is disposed, as the second vertical deflection coil 32, in the grooves 45 between the plurality of magnetic substance convex portions 42 in a ridge shape. Therefore, the magnetic field generated by the second vertical deflection coil 32 functions so as to suppress a vertical deflection magnetic field from becoming a barrel type, which otherwise would become conspicuous with only the magnetic field generated by the first vertical deflection coil 30. Consequently, an optimum barrel magnetic field capable of realizing a satisfactory convergence and raster can be formed easily.

For example, in the example, inner pincushion distortion of rasters in upper and lower portions occurred by an amount of 0.7 mm on an average of the upper and lower portions, and a misconvergence called S1 in the periphery of a screen occurred by an amount of 0.4 mm on an average of four corners.

Figure 7:
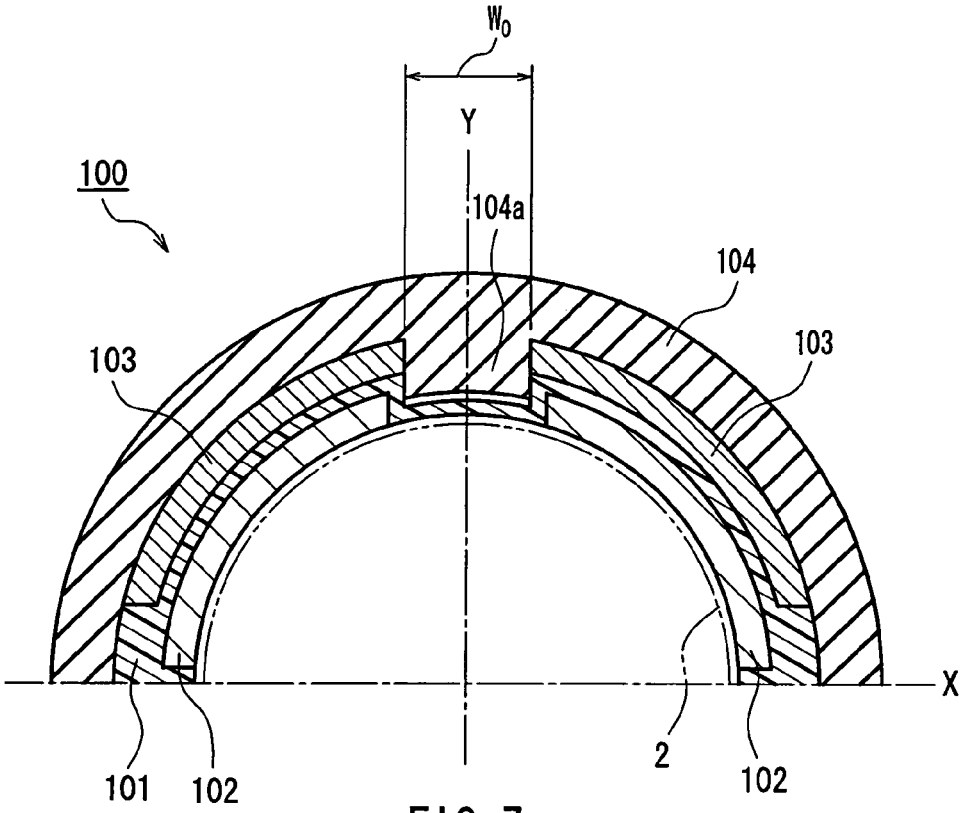
FIG. 7 PRIOR ART
FIG. 7 is a partial cross-sectional view of a conventional deflection yoke.
Figure 8:
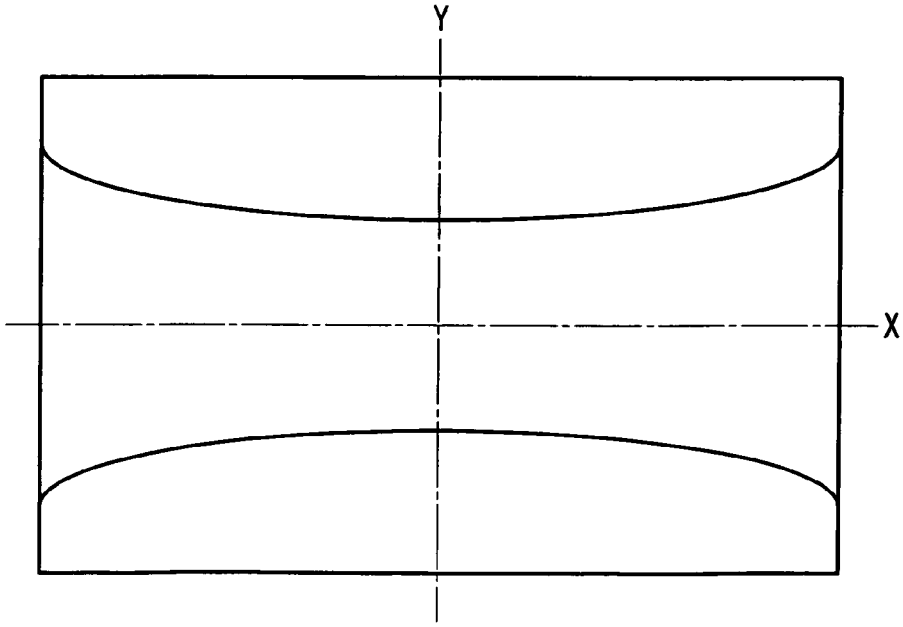
FIG. 8 PRIOR ART
FIG. 8 is a view showing an example of inner pincushion distortion of rasters in upper and lower portions in a conventional color picture tube apparatus.

In contrast, as shown in FIG. 7, in the conventional color picture tube apparatus that is the same as the above-mentioned example except for the following: the magnetic substance projections 104*a* with the width $W_0$ of 12 mm were formed, and the grooves 45 were not formed, so that the second vertical deflection coil 32 was not formed, inner pincushion distortion of rasters in upper and lower portions as shown in FIG. 8 occurred by an amount of 1.5 mm on an average of the upper and lower portions, and a misconvergence called S1 in the periphery of a screen occurred by an amount of 1.0 mm on an average of four corners.

Thus, in the conventional color picture tube apparatus, the vertical deflection coils 103 cannot be disposed in regions where the magnetic substance projections 104*a* with the width $W_0$ are formed, so that the vertical deflection coils 103 arranged on both sides with respect to the YZ-plane are apart from each other by the distance $W_0$. Consequently, a barrel magnetic field of a vertical deflection magnetic field is emphasized more than necessary. Therefore, a misconvergence and raster distortion are degraded.

According to the present invention, even when the separation distance W between the first vertical deflection coils 30 arranged on both sides with respect to the YZ-plane is the same as the conventional separation distance $W_0$, by forming the plurality of magnetic substance convex portions 42 in a region with the width W, and arranging a part of the vertical deflection coil (second vertical deflection coil 32) in the grooves 45 between the plurality of magnetic substance convex portions 42, satisfactory convergence and raster characteristics can be realized without impairing the power-saving effect.

The magnetic substance convex portions 42 may be molded integrally with the ferrite core 40, or a member produced separately from the ferrite core 40 may be attached to an inner surface of the ferrite core 40.

Embodiment 2

Figure 4:
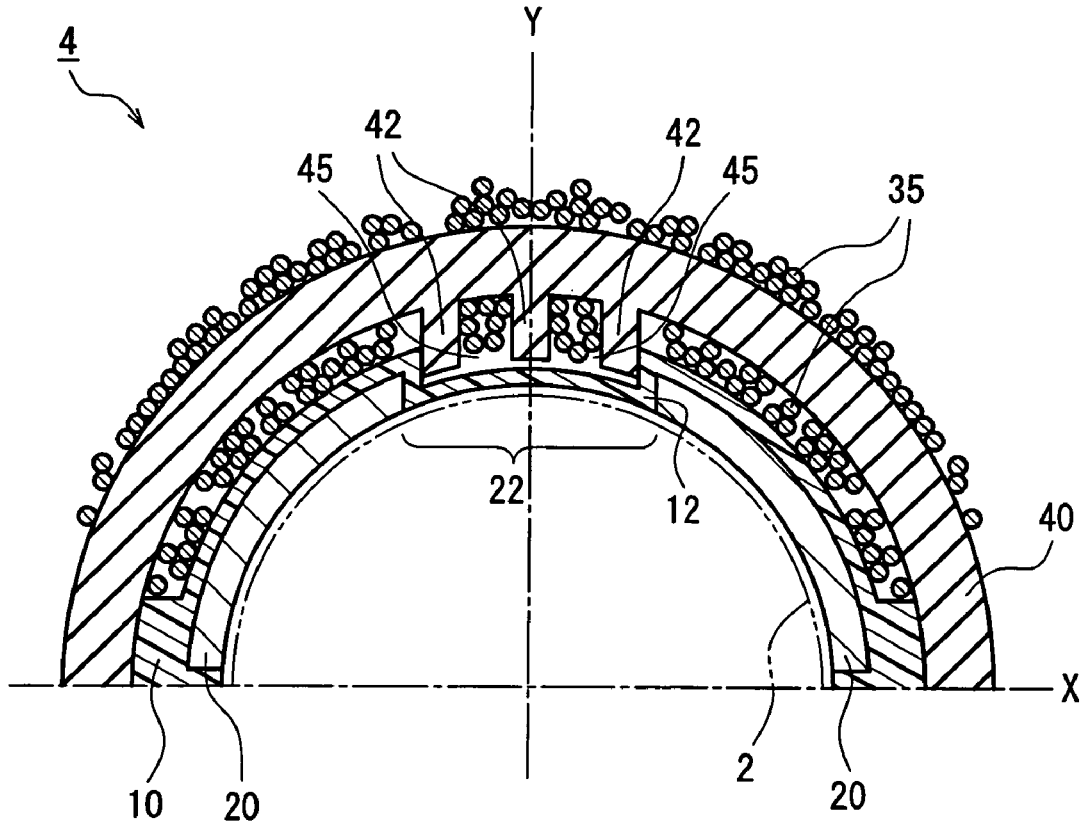
FIG. 4 is a partial cross-sectional view of a deflection yoke to be mounted on a color picture tube apparatus according to Embodiment 2 of the present invention.

FIG. 4 is a partial cross-sectional view of the deflection yoke 4 to be mounted on a color picture tube apparatus according to Embodiment 2 of the present invention. The cross-sectional shape of the deflection yoke 4 is symmetrical with respect to the XZ-plane, so that FIG. 4 shows only an upper half from the XZ-plane in the same way as in FIG. 3.

Embodiment 2 is different from Embodiment 1 in the following points. That is, the vertical deflection coil of Embodiment 1 is composed of the toroidal second vertical deflection coil 32 wound in the grooves 45, and the saddle-type first vertical deflection coil 30 wound around the part other than the grooves 45. In contrast, a vertical deflection coil 35 of Embodiment 2 has a configuration in which a winding is wound in a toroidal shape over the entire portion. Because of this, the toroidal vertical deflection coil 35 can be formed by allowing one wire to continuously turn around the ferrite core 40 in the portions of the grooves and the other portion. Therefore, the operation for forming the vertical deflection coil 35 becomes easy.

Embodiment 2 is similar to Embodiment 1 except for the above, and exhibits the same effect as that of Embodiment 1.

Embodiment 3

Figure 5:
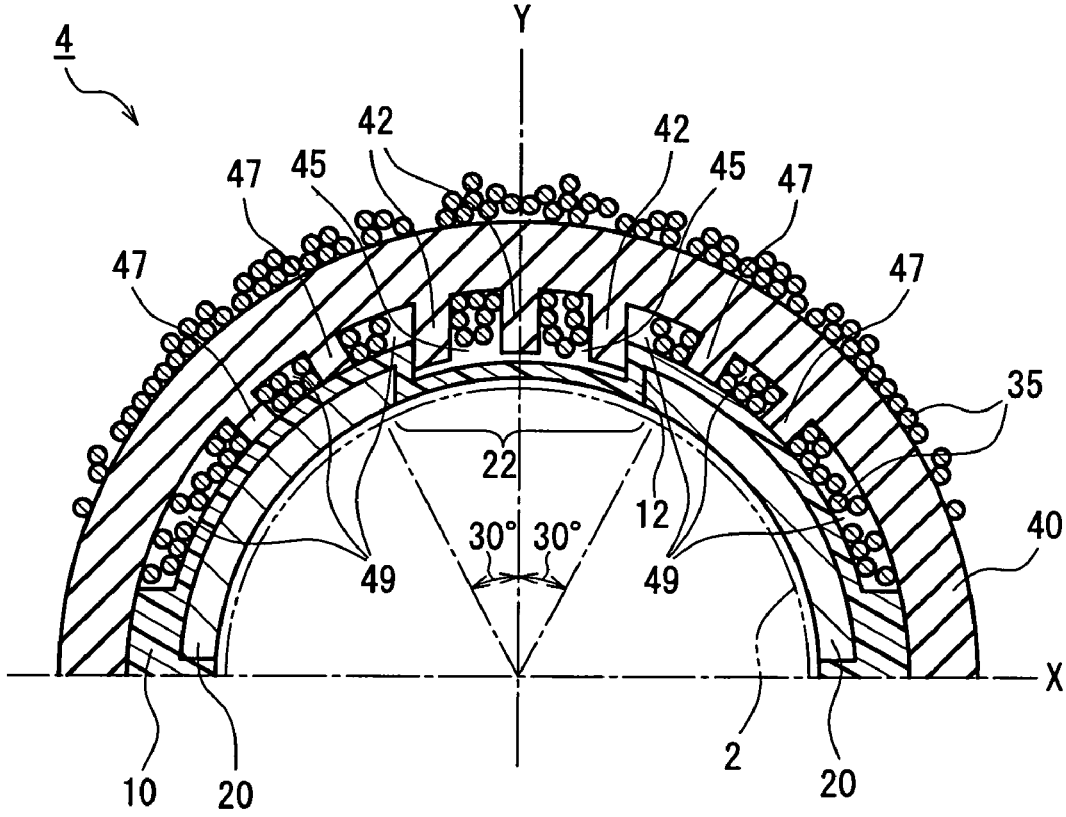
FIG. 5 is a partial cross-sectional view of a deflection yoke to be mounted on a color picture tube apparatus according to Embodiment 3 of the present invention.

FIG. 5 is a partial cross-sectional view of the deflection yoke 4 to be mounted on a color picture tube apparatus according to Embodiment 3 of the present invention. The cross-sectional shape of the deflection yoke 4 is symmetrical with respect to the XZ-plane, so that FIG. 5 shows only an upper half from the XZ-plane in the same way as in FIGS. 3 and 4.

Embodiment 3 will be described mainly based on the difference from Embodiment 2.

In Embodiment 3, in a region on an inner side surface of the ferrite core 40 other than the region opposed to the window portion 22 of the horizontal deflection coil 20, a plurality of second convex portions 47 in a ridge shape projecting toward the insulating frame are formed. In the Z-axis direction, the second convex portions 47 extend to both ends of the ferrite core 40 in the Z-axis direction substantially along a surface including the Z-axis. The ferrite core provided with such second convex portions 47 generally is called a slot core.

A winding of the vertical deflection coil 35 is wound, in a toroidal shape, in second grooves 49 between the second convex portions 47 adjacent in a circumferential direction. Thus, in the same way as in Embodiment 2, the toroidal vertical deflection coil 35 can be formed in the second grooves 49 and the grooves (first grooves) 45 by allowing one wire to continuously turn around the ferrite core 40. Therefore, the operation for forming the vertical deflection coil 35 becomes easy.

The ferrite core 40 can be set to be close to the funnel 2 by forming the second convex portions 47, so that the deflection efficiency is enhanced, and the power consumption can be reduced.

FIG. 5 shows an example in which a winding is wound, in a toroidal shape, in the grooves 49 and the grooves 45.

However, a winding also can be wound, in a saddle shape, in one or both of the second groove 49 and the groove 45.

Furthermore, FIG. 5 shows an example in which the second convex portions 47 are not provided in the vicinity of the X-axis. However, the second convex portions 47 may be provided also in the vicinity of the X-axis in terms of the reduction in deflection power.

In terms of the reduction in deflection power, it is preferable that the tip ends of the second convex portions 47 on the Z-axis side are set to be as close to the funnel 2 as possible. Unlike the magnetic substance convex portions 42 projecting toward the window portion 22 of the horizontal deflection coil 20, there is a limit to the arrangement of the second convex portions 47 due to the presence of the horizontal deflection coil 20 between the second convex portions 47 and the funnel 2. That is, assuming that the distance between the tip ends of the magnetic substance convex portions 42 on the Z-axis side and the funnel 2 is $D_1$, and the distance between the tip ends of the second convex portions 47 on the Z-axis side and the funnel 2 is $D_2$, $D_2>D_1$ is satisfied.

In the above example, $D_1$ was set to be 1.7 mm. Only the insulating frame 10 is present between the magnetic substance convex portions 42 and the funnel 2. Therefore, in general, assuming that the thickness of the insulating frame 10 is 0.8 to 1.2 mm, the gap between the magnetic substance convex portions 42 and the insulating frame 10 is 0.2 mm, and the gap between the insulating frame 10 and the funnel 2 is 0.5 mm, the above-mentioned distance $D_1$ can be set to be 1.9 mm or less.

On the other hand, the horizontal deflection coil 20 is present between the second convex portions 47 and the funnel 2. Therefore, assuming that the minimum thickness of the horizontal deflection coil 20 is 0.4 mm, the thickness of the insulating frame 10 is 0.8 to 1.2 mm, the gap between the magnetic substance convex portions 42 and the insulating frame 10 is 0.2 mm, and the gap between the insulating frame 10 and the funnel 2 is 0.5 mm, the above-mentioned distance $D_2$ becomes 1.9 mm or more.

In the case where the plurality of magnetic substance convex portions 42 and the plurality of second convex portions 47 are provided as shown in FIG. 5, when the distance between the respective tip ends on the Z-axis side and the funnel 2 is varied, the distances $D_1$ and $D_2$ are defined as follows. The distance $D_1$ is assumed to be the minimum value among the distances between the respective plurality of convex portions present in a range of ±30° from the Y-axis with respect to the Z-axis and the funnel 2. Furthermore, the distance $D_2$ is assumed to be the minimum value among the distances between the respective plurality of convex portions present in a range exceeding ±30° from the Y-axis with respect to the Z-axis and the funnel 2.

Embodiment 4

Figure 6A:
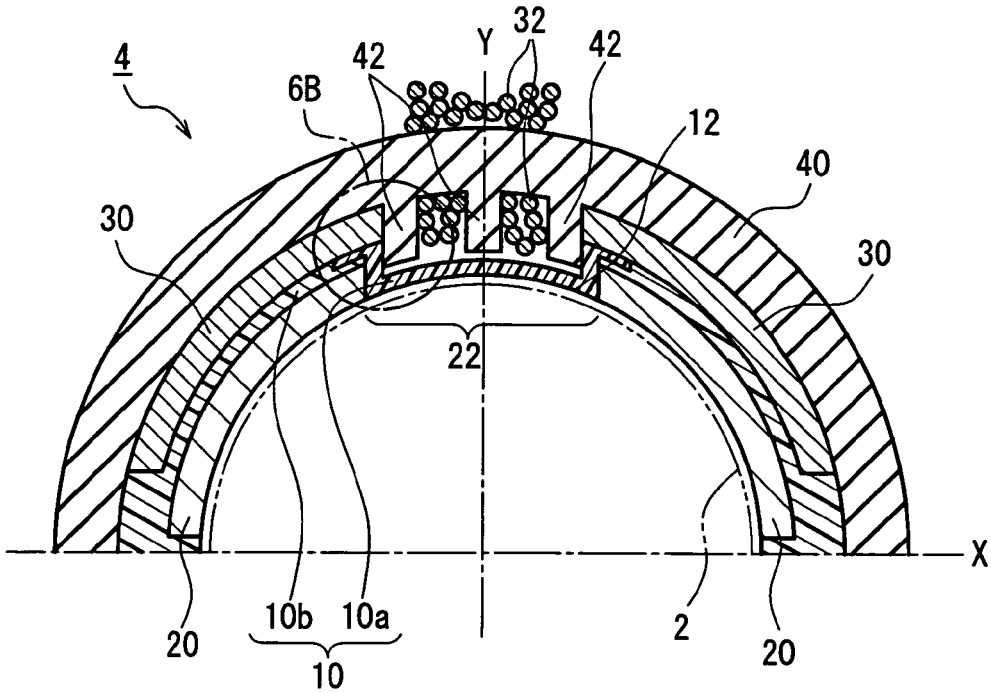
FIG. 6A is a partial cross-sectional view of a deflection yoke to be mounted on a color picture tube apparatus according to Embodiment 4 of the present invention.
Figure 6B:
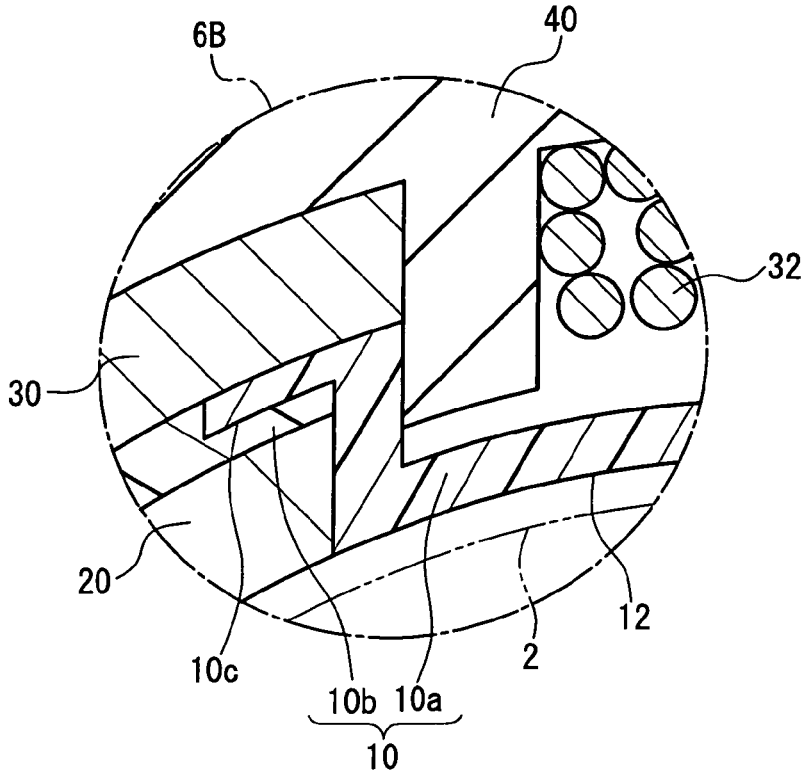
FIG. 6B is an enlarged cross-sectional view of a portion 6B in FIG. 6A.

FIG. 6A is a partial cross-sectional view of the deflection yoke 4 to be mounted on a color picture tube apparatus according to Embodiment 4 of the present invention. The cross-sectional shape of the deflection yoke 4 is symmetrical with respect to the XZ-plane, so that FIG. 6A shows only an upper half from the XZ-plane in the same way as in FIGS. 3 to 5. FIG. 6B is an enlarged cross-sectional view of a portion 6B in FIG. 6A.

Embodiment 4 will be described based on the difference from Embodiment 1.

In Embodiment 4, the insulating frame 10 is composed of at least two components (a first component 10*a* constituting the insulating frame convex portion 12 and a second component 10*b* constituting a portion other than the insulating frame convex portion 12).

In general, the insulating frame 10 substantially in a funnel shape is obtained, for example, by respectively molding two components in a semi-funnel shape divided by the XZ-plane with resin, and connecting them to each other. In order to mold the component in a semi-funnel shape having the insulating frame convex portion 12 with resin using a mold at one time, it is necessary to combine three or more mold components in view of a releasing property of a molding from a mold, which increases a molding cost.

The insulating frame 10 of the present embodiment has a configuration in which the first component 10*a* and the second component 10*b* molded separately with resin are combined. Because of this, the first component 10*a* and the second component 10*b* can be molded respectively using two mold components, which enhances productivity as a whole and reduces cost.

In the case where the insulating frame 10 is composed of separate components (i.e., the first component 10*a* and the second component 10*b*), there is a possibility that the insulation between the horizontal deflection coil 20 and the vertical deflection coils 30, 32, arranged on both sides with respect to the insulating frame 10, may be decreased. In the present embodiment, as shown in FIG. 6B, a connection portion between the first component 10*a* and the second component 10*b* is formed in a step shape having a connection surface 10*c* along a circumferential direction. Because of this, an extending surface distance between the horizontal deflection coil 20 and the vertical deflection coils 30, 32 is kept, whereby the insulation is prevented from being decreased.

Even in Embodiments 2 and 3, the insulating frame 10 including the above-mentioned combination of the first component 10*a* and the second component 10*b* can be used.

In Embodiments 1 to 4, the magnetic substance convex portions 42 are provided over the entire length L of the ferrite core 40 in the Z-axis direction. Furthermore, in Embodiment 3, the second convex portions 47 also are provided over the entire length L of the ferrite core 40 in the Z-axis direction. However, the magnetic substance convex portions 42 and/or the second convex portions 47 of the present invention are not limited thereto, and they may be provided only in a part of the entire length L of the ferrite core 40.

It is preferable that the deflection yoke 4 of the present invention has the cross section shown in FIG. 3, 4, 5, or 6A at some point on the Z-axis. More exactly, the following A to C are satisfied in a cross section orthogonal to the Z-axis at one or more points on the Z-axis.

A. The plurality of magnetic substance convex portions 42 projecting toward the Z-axis are provided in the vicinity of a position of an inner surface of the ferrite core 40 where the Y-axis crosses.

B. Assuming that a minimum value among the distances between the respective plurality of magnetic substance convex portions 42 and the funnel 2 is $D_1$, the distance between the ferrite core 40 excluding the plurality of magnetic substance convex portions 42 and the funnel 2 is larger than the distance $D_1$ at any point of the ferrite core 40.

C. Apart of the vertical deflection coil 32 is wound in the grooves 45 between the plurality of magnetic substance convex portions 42.

The position of the cross section discussed above in the Z-axis direction is not particularly limited. However, assuming that the size of the ferrite core 40 in the Z-axis direction is L, it is preferable that the cross section is present at least between an end of the ferrite core 40 on the electron gun 3 side and a position away from the end of the ferrite core 40 on the electron gun 3 side toward the front panel 1 side by (⅔)×L. In a region in the vicinity of the end of the ferrite core 40 on the electron gun side that is a small diameter side, the distance between the ferrite core 40 and the electron beams is small. Therefore, if the magnetic substance convex portions 42 (preferably, in addition, the second convex portions 47) are provided in this region, the distance between the ferrite core 40 and the electron beams can be reduced largely, so that a large effect of reducing deflection power can be obtained. Furthermore, if the magnetic substance convex portions 42 and the second convex portions 47 are not provided on a large diameter side, the degree of freedom in winding arrangement of the vertical deflection coil is enhanced.

The applicable field of the color picture tube apparatus of the present invention is not particularly limited, and the color picture tube apparatus can be used in a wide range, such as a TV, a computer display, or the like.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A color picture tube apparatus, comprising:

an envelope composed of a front panel and a funnel;

an electron gun provided in a neck portion of the funnel; and a deflection yoke for allowing a horizontal deflection magnetic field and a vertical deflection magnetic field to act on three electron beams emitted from the electron gun in an in-line shape, thereby deflecting the three electron beams in a horizontal direction and a vertical direction, wherein the deflection yoke includes a ferrite core, a horizontal deflection coil for generating the horizontal deflection magnetic field, a vertical deflection coil for generating the vertical deflection magnetic field, and an insulating frame for insulating the horizontal deflection coil from the vertical deflection coil, assuming that a tube axis is a Z-axis, an axis in a horizontal direction orthogonal to the Z-axis is an X-axis, and an axis in a vertical direction orthogonal to the Z-axis and the X-axis is a Y-axis, the horizontal deflection coil has a window portion, in which a winding is not present, at a position where a YZ-plane including the Y-axis and the Z-axis crosses, and the deflection yoke has at least one cross section orthogonal to the Z-axis that satisfies the following A to C:

A. in the cross section, a plurality of magnetic substance convex portions projecting toward the Z-axis are provided in the vicinity of a position of an inner surface of the ferrite core where the Y-axis crosses;

B. in the cross section, assuming that a minimum value among distances between the respective plurality of magnetic substance convex portions and the funnel is $D_1$, a distance between the ferrite core excluding the plurality of magnetic substance convex portions and the funnel is larger than the distance $D_1$ at any point of the ferrite core; and C. a part of the vertical deflection coil is wound in a groove between the plurality of magnetic substance convex portions.

2. The color picture tube apparatus according to claim 1, wherein, in the cross section, the plurality of magnetic substance convex portions are provided in a range of ±30° from the Y-axis with respect to the Z-axis.

3. The color picture tube apparatus according to claim 1, wherein the vertical deflection coil is a saddle type in a part other than the part wound in the groove.

4. The color picture tube apparatus according to claim 1, wherein the horizontal deflection coil is a mold winding coil wound using a mold.

5. The color picture tube apparatus according to claim 1, wherein, in the cross section, the insulating frame includes an insulating frame convex portion projecting toward the window portion in a region opposed to the plurality of magnetic substance convex portions.

6. The color picture tube apparatus according to claim 5, wherein the insulating frame convex portion is inserted in the window portion of the horizontal deflection coil.

7. The color picture tube apparatus according to claim 1, wherein, in the cross section, the plurality of magnetic substance convex portions are inserted in the window portion of the horizontal deflection coil.

8. The color picture tube apparatus according to claim 1, wherein the vertical deflection coil is a toroidal type in the part wound in the groove and a part other than the part wound in the groove.

9. The color picture tube apparatus according to claim 1, wherein, in the cross section, a plurality of second convex portions projecting toward the Z-axis are provided in a region of an inner surface of the ferrite core other than a region opposed to the window portion of the horizontal deflection coil, and a part of the vertical deflection coil is wound in a second groove between the plurality of second convex portions.

10. The color picture tube apparatus according to claim 9, wherein, assuming that a distance between the second convex portions and the funnel is $D_2$, $D_1<D_2$ is satisfied.

11. The color picture tube apparatus according to claim 5, wherein the insulating frame convex portion is composed of a component separate from a component constituting a portion of the insulating frame other than the insulating frame convex portion.

12. The color picture tube apparatus according to claim 1, wherein, assuming that a size of the ferrite core along the Z-axis is L, the cross section is present at least between an end of the ferrite core on the electron gun side and a position away from the end of the ferrite core on the electron gun side toward the front panel side by (⅔)×L.

* * * * *